US007878854B2

(12) United States Patent
Morgan et al.

(10) Patent No.: US 7,878,854 B2
(45) Date of Patent: Feb. 1, 2011

(54) ELECTRICAL CONNECTOR HAVING VARIABLE LENGTH MOUNTING CONTACTS

(75) Inventors: Chad William Morgan, Woolwich Township, NJ (US); David Wayne Helster, Dauphin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 168 days.

(21) Appl. No.: 12/176,954

(22) Filed: Jul. 21, 2008

(65) Prior Publication Data

US 2010/0015822 A1 Jan. 21, 2010

(51) Int. Cl.
*H01R 13/648* (2006.01)

(52) U.S. Cl. ..... 439/607.39; 439/924.1

(58) Field of Classification Search ..... 439/24.1, 439/607.39, 78, 82, 607.05–607.11
See application file for complete search history.

(56) References Cited

U.S. PATENT DOCUMENTS 6,371,773 B1 4/2002 Crofoot et al.
6,663,442 B1 12/2003 Helster et al.
6,817,870 B1 * 11/2004 Kwong et al. ..... 439/74
2004/0005795 A1 1/2004 Wu
2008/0176452 A1 7/2008 Fedder et al.

FOREIGN PATENT DOCUMENTS

WO WO 2008/002376 A2 1/2008

OTHER PUBLICATIONS

International Search Report, International Application No. PCT/US2009/003916, International Filing Date Jan. 7, 2009.

* cited by examiner

*Primary Examiner*—Ross N Gushi

(57) ABSTRACT

An electrical connector is provided for mounting on a circuit board having first and second vias. The electrical connector includes a housing having a mounting face for mounting along the circuit board, and first and second signal terminals held by the housing. The first and second signal terminals include respective first and second mounting contacts extending outward from the mounting face of the housing. The first and second mounting contacts are configured to be received within the first and second vias, respectively, of the circuit board. The first mounting contact extends a different length from the mounting face of the housing than the second mounting contact.

18 Claims, 6 Drawing Sheets

ELECTRICAL CONNECTOR HAVING VARIABLE LENGTH MOUNTING CONTACTS

BACKGROUND OF THE INVENTION

The subject matter described and/or illustrated herein relates generally to electrical connectors and, more particularly, to electrical connectors that are mounted on circuit boards.

To meet digital multi-media demands, higher data throughput is often desired for current digital communications equipment. Electrical connectors that interconnect circuit boards must therefore handle ever increasing signal speeds at ever increasing signal densities. However, at the footprints of the circuit boards where the electrical connectors connect thereto it may be difficult to improve density while maintaining electrical performance and/or reasonable manufacturing cost. For example, vias within the circuit boards must be large enough to plate for a given circuit board thickness, but must also be far enough apart from one another to maintain electrical performance (e.g., impedance and/or noise). To increase the number of vias, and therefore increase the density of the circuit board footprint, the vias must be smaller and/or closer together. However, moving the vias closer together degrades the electrical performance of the circuit board footprint, while decreasing the size of the vias may increase manufacturing costs by increasing the difficulty of plating the vias. Circuit board footprints are currently the bottleneck for achieving higher system densities and/or higher system speeds.

Different known approaches have been used to improve the electrical performance and/or density of circuit board footprints. For example, careful via placement, anti-pad optimization, and counter boring of via stubs have been used to improve circuit board footprints. However, to achieve higher system densities and speed, further improvement of circuit board footprints must be made over known approaches.

There is a need for an electrical connector that enables improvement of the density and/or electrical performance of circuit board footprints to achieve higher system densities and/or higher system speeds.

BRIEF DESCRIPTION OF THE INVENTION

In one embodiment, an electrical connector is provided for mounting on a circuit board having first and second vias. The electrical connector includes a housing having amounting face for mounting along the circuit board, and first and second signal terminals held by the housing. The first and second signal terminals include respective first and second mounting contacts extending outward from the mounting face of the housing. The first and second mounting contacts are configured to be received within the first and second vias, respectively, of the circuit board. The first mounting contact extends a different length from the mounting face of the housing than the second mounting contact.

In another embodiment, a contact module is provided for an electrical connector. The contact module includes a housing having a mounting face for mounting along a circuit board, and a lead frame held by the housing. The lead frame includes first and second signal terminals comprising respective first and second mounting contacts extending outward from the mounting face of the housing. The first and second mounting contacts are configured to be electrically connected to the circuit board. The first mounting contact extends a different length from the mounting face of the housing than the second mounting contact.

In another embodiment, an electrical connector assembly is provided that includes a circuit board including first and second vias each extending at least partially through the circuit board, and an electrical connector configured to be mounted on the circuit board. The electrical connector includes a housing having a mounting face configured to be mounted along the circuit board, and first and second signal terminals held by the housing. The first and second signal terminals include respective first and second mounting contacts extending outward from the mounting face of the housing. The first and second mounting contacts are configured to be received within the first and second vias, respectively, of the circuit board. The first and second mounting contacts are configured to extend different depths into the respective first and second vias of the circuit board.

DETAILED DESCRIPTION OF THE INVENTION

Figure 1:
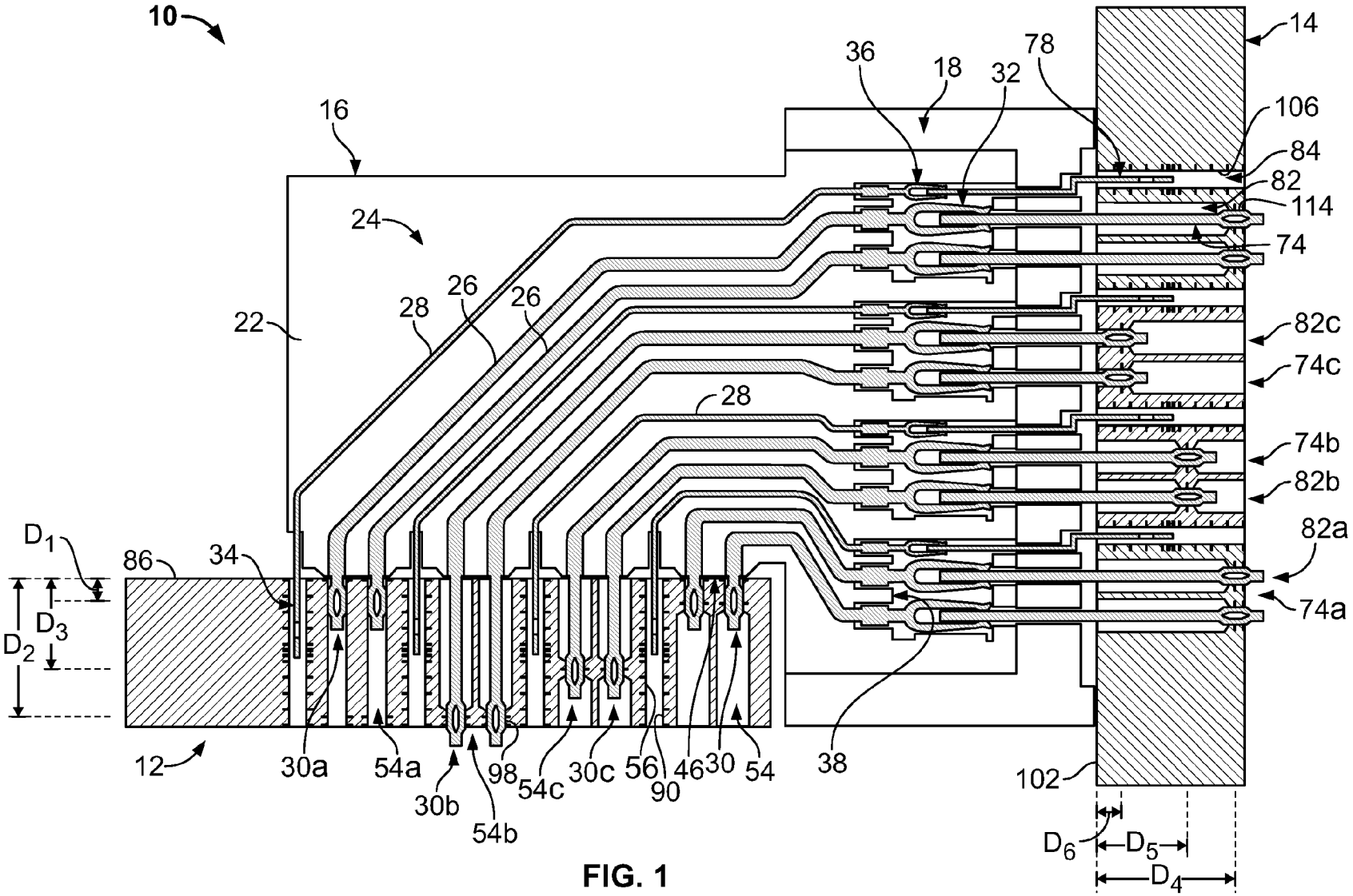
FIG. 1 is a cross-sectional view of an exemplary embodiment of an electrical connector assembly.

FIG. 1 is a cross-sectional view of an exemplary embodiment of an electrical connector assembly 10. The connector assembly 10 includes a pair of circuit boards 12 and 14, a receptacle connector 16, and a header connector 18. The receptacle connector 16 is mounted on the circuit board 12, and the header connector 18 is mounted on the circuit board 14. The receptacle connector 16 and the header connector 18 are connected together to electrically connect the circuit boards 12 and 14. In the exemplary embodiment of FIG. 1, the receptacle connector 16 and the header connector 18 are oriented such that the connectors 16 and 18 form an approximate right-angle connection between the circuit boards 12 and 14. Alternatively, the receptacle connector 16 and the header connector 18 may be oriented such that the circuit boards 12 and 14 are oriented at any other angle relative to each other, such as, but not limited to, approximately parallel.

Figure 2:
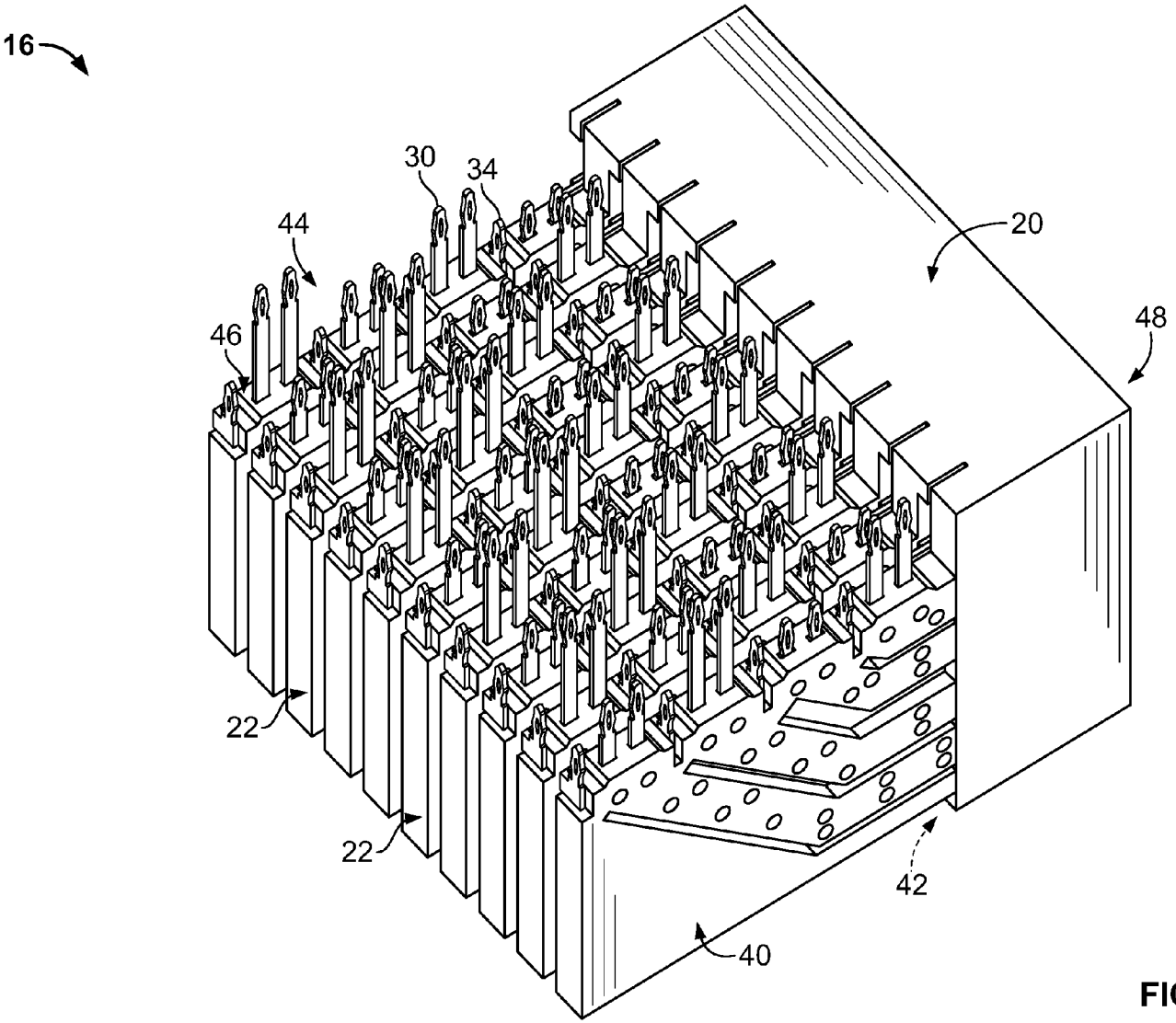
FIG. 2 is a perspective view of an exemplary embodiment of a receptacle connector of the electrical connector assembly shown in FIG. 1.
Figure 3:
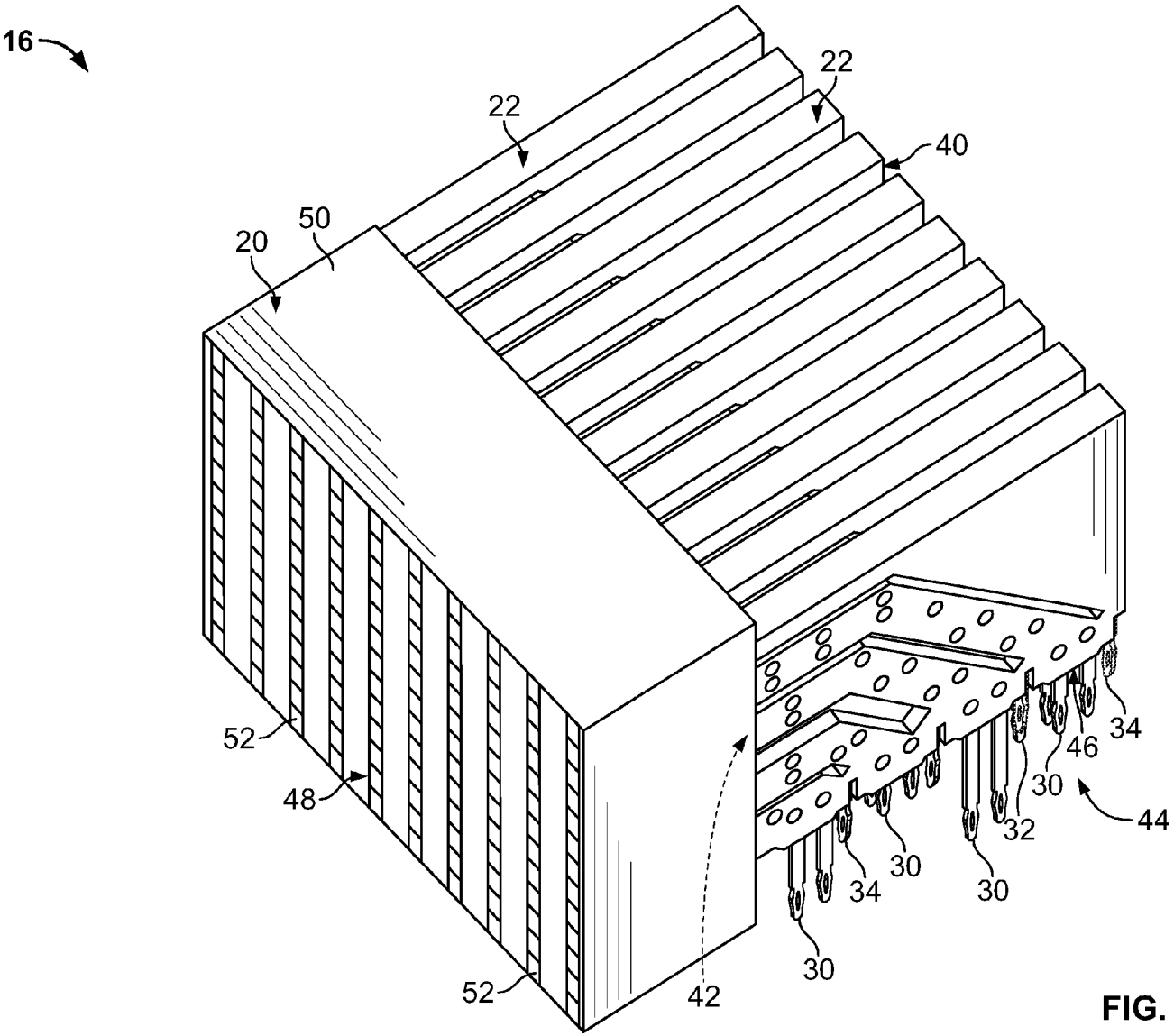
FIG. 3 is another perspective view of the receptacle connector shown in FIG. 2.

FIGS. 2 and 3 are perspective views of an exemplary embodiment of the receptacle connector 16. The receptacle connector 16 includes a dielectric housing 20 that, in the illustrated embodiment, holds a plurality of contact modules 22. Referring to FIG. 1, each contact module 22 includes a contact lead frame 24 that includes a plurality of signal terminals 26 and a plurality of ground terminals 28. Each signal terminal 26 includes a mounting contact 30 at one end portion of the signal terminal 26 and a mating contact 32 at an opposite end portion of the signal terminal 26. Similarly, each ground terminal 28 includes a mounting contact 34 at one end portion of the ground terminal 28 and a mating contact 36 at an opposite end portion of the ground terminal 28. The mating contacts 32 and 36 extend outward from, and along, a mating face 38 of the contact module 22. The signal terminals 26 are optionally arranged in differential pairs, as the signal terminals 26 are shown in illustrated embodiment. In addition or alternative to the ground terminals 28, one or more of the contact modules 22 may include a ground shield (not shown) that includes the mounting and mating contacts 34 and 36, respectively, and provides a common ground for the corresponding contact module 22.

Referring again to FIGS. 2 and 3, a dielectric contact module housing 40 of each contact module 22 holds the corresponding lead frame 24 (FIG. 1). Each contact module housing 40 includes a mating end portion 42 that includes the mating face 38 (FIG. 1) and a mounting end portion 44 that includes a mounting face 46. In the illustrated embodiment, the mating face 38 is approximately perpendicular to the mounting face 46. However, the mating face 38 and mounting face 46 may be oriented at any other angle relative to each other, such as, but not limited to, approximately parallel. As best seen in FIG. 3, the housing 20 includes a mating face 48, an upper shroud 50 extending from the mating face 48, and a plurality of contact channels 52 that extend into the housing 20 through the mating face 48. The mating end portion 42 of each contact module is received in the housing 20 such that each of the mating contacts 32 and 36 (FIG. 1) is aligned with a corresponding contact channel 52. The contact channels 52 are configured to receive mating contacts of a header connector (such as, but not limited to, the mating contacts 76 and 80, shown in FIG. 5, of the header connector 18, shown in FIGS. 1, 5, and 6) such that each of the mating contacts 76 and 80 of the header connector 18 engages a corresponding mating contact 32 or 36 of the receptacle connector 16.

The mounting end portion 44 of each of the contact modules 22 is configured for mounting on a circuit board, such as, but not limited to, the circuit board 12 (FIG. 1). The mounting contacts 30 and 34 extend outward from, and along, the mounting face 46 of the contact modules 22 for mechanical and electrical connection to the circuit board 12. Specifically, each of the mounting contacts 30 and 34 is configured to be received within a corresponding via 54 and 56 (FIGS. 1 and 4), respectively, within the circuit board 12.

In alternative to the plurality of contact modules 22 held by the housing 20 of the receptacle connector 16, the signal and ground terminals 26 and 28, respectively, of the receptacle connector 16 may be held by a single housing (not shown), which may be integral with, or alternatively held by, the housing 20.

Figure 4:
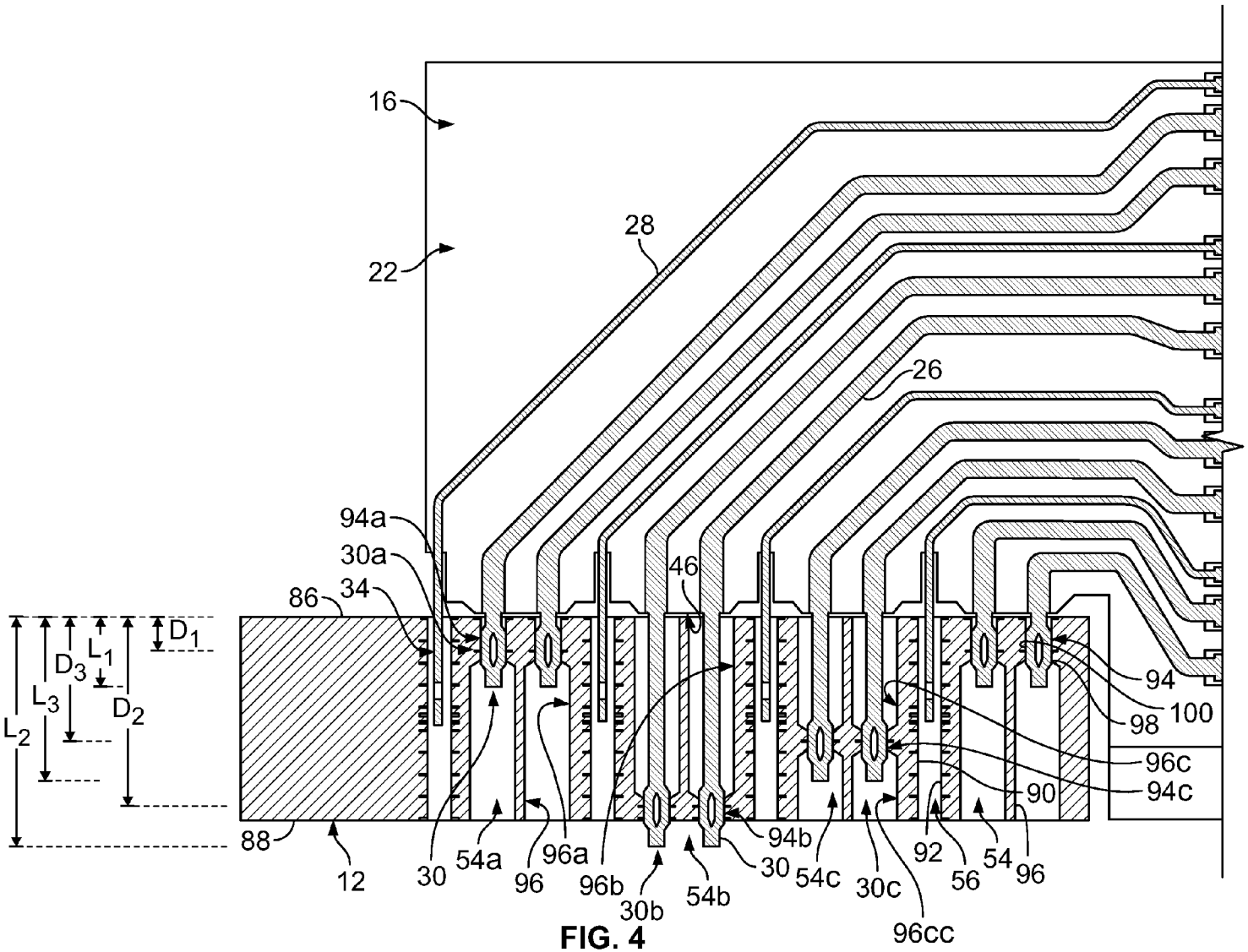
FIG. 4 is a cross-sectional view of a portion of the electrical connector assembly shown in FIG. 1.

Referring now to FIG. 4, some of the mounting contacts 30 of the signal terminals 26 extend different lengths from the mounting face 46 of the corresponding contact module 22 than others of the mounting contacts 30 (whether the others are on the same contact module 22 or a different contact module 22). For example, a differential pair 30*a* of the mounting contacts 30 extends a length $L_1$ from the mounting face 46, a differential pair 30*b* of the mounting contacts 30 extends a length $L_2$ from the mounting face 46, and a differential pair 30*c* of the mounting contacts 30 extend a length $L_3$ from the mounting face 46. As can be seen in FIG. 4, the lengths $L_1$-$L_3$ are each different. Any of the mounting contacts 30 of the receptacle connector 16 may have a different length from the corresponding mounting face 46 than any other mounting contact 30 of the receptacle connector 16. The pattern of the lengths of the mounting contacts 30 shown herein is meant as exemplary only. Although the mounting contacts 30 of each differential pair are shown herein as having approximately the same length from the mounting face 46, alternatively one or more differential pairs includes mounting contacts 30 that have different lengths.

Figure 5:
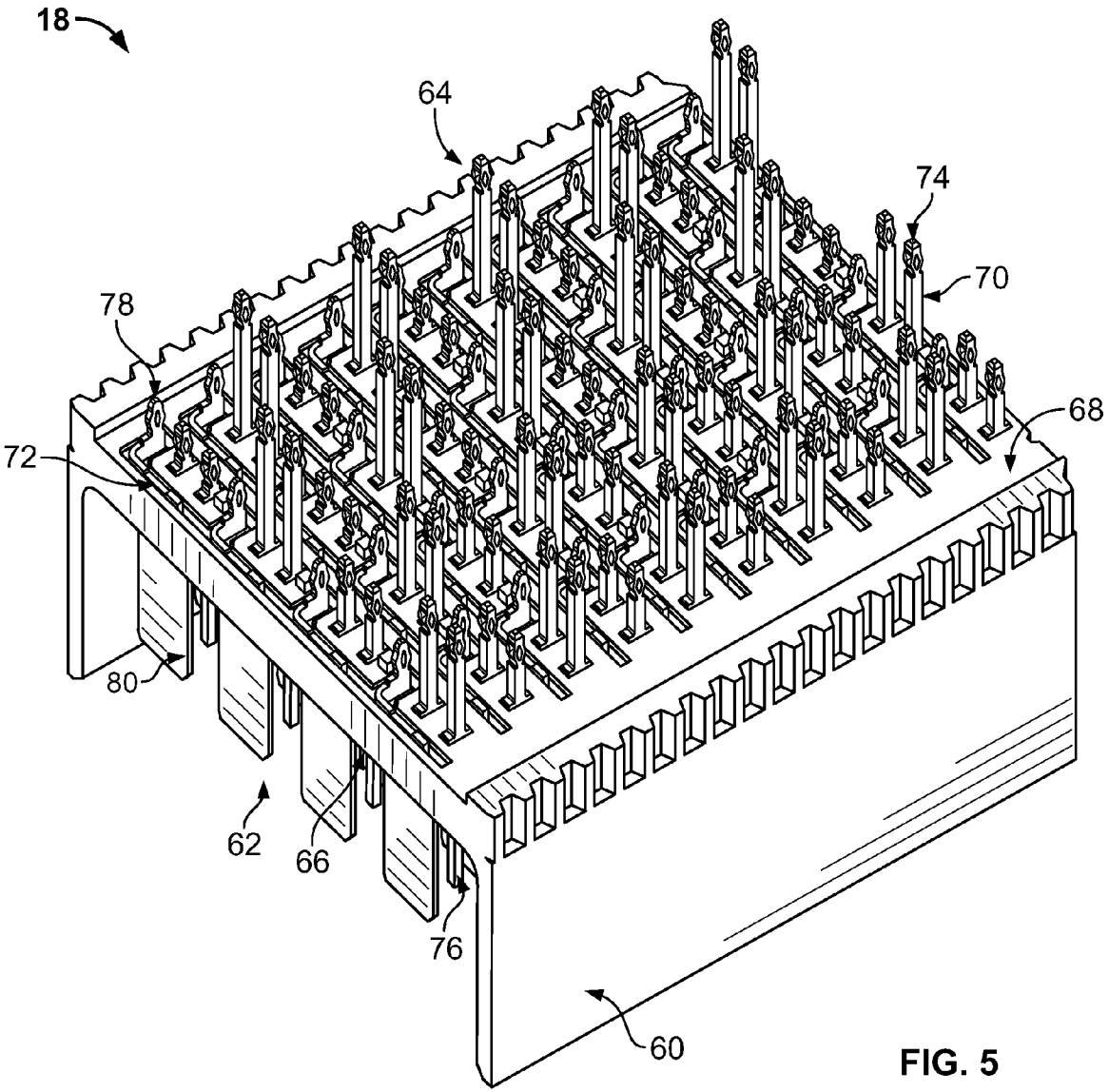
FIG. 5 is a perspective view of an exemplary embodiment of a header connector of the electrical connector assembly shown in FIG. 1.

FIG. 5 is a perspective view of an exemplary embodiment of the header connector 18. The header connector 18 includes a dielectric housing 60 having a mating end portion 62 that receives the receptacle connector 16 (FIGS. 1-4) and a mounting end portion 64 for mounting the header connector 18 to a circuit board, such as, but not limited to, the circuit board 14. The mating end portion 62 includes a mating face 66 and the mounting end portion 64 includes a mounting face 68. The housing 60 holds a plurality of signal terminals 70 and a plurality of ground terminals 72. The signal terminals 70 are optionally arranged in differential pairs, as the signal terminals 70 are shown in the illustrated embodiment.

Each signal terminal 70 includes a mounting contact 74 at one end portion of the signal terminal 70 and the mating contact 76 at an opposite end portion of the signal terminal 70. Similarly, each ground terminal 72 includes a mounting contact 78 at one end portion of the ground terminal 72 and the mating contact 80 at an opposite end portion of the ground terminal 72. The mounting contacts 74 and 78 extend outward from, and along, the mounting face 68 of the header connector 18, while the mating contacts 76 and 80 extend outward from, and along, the mating face 66 of the header connector 18. Each of the mounting contacts 74 and 78 is configured to be received within a corresponding via 82 and 84 (FIGS. 1 and 6), respectively, within the circuit board 14.

Figure 6:
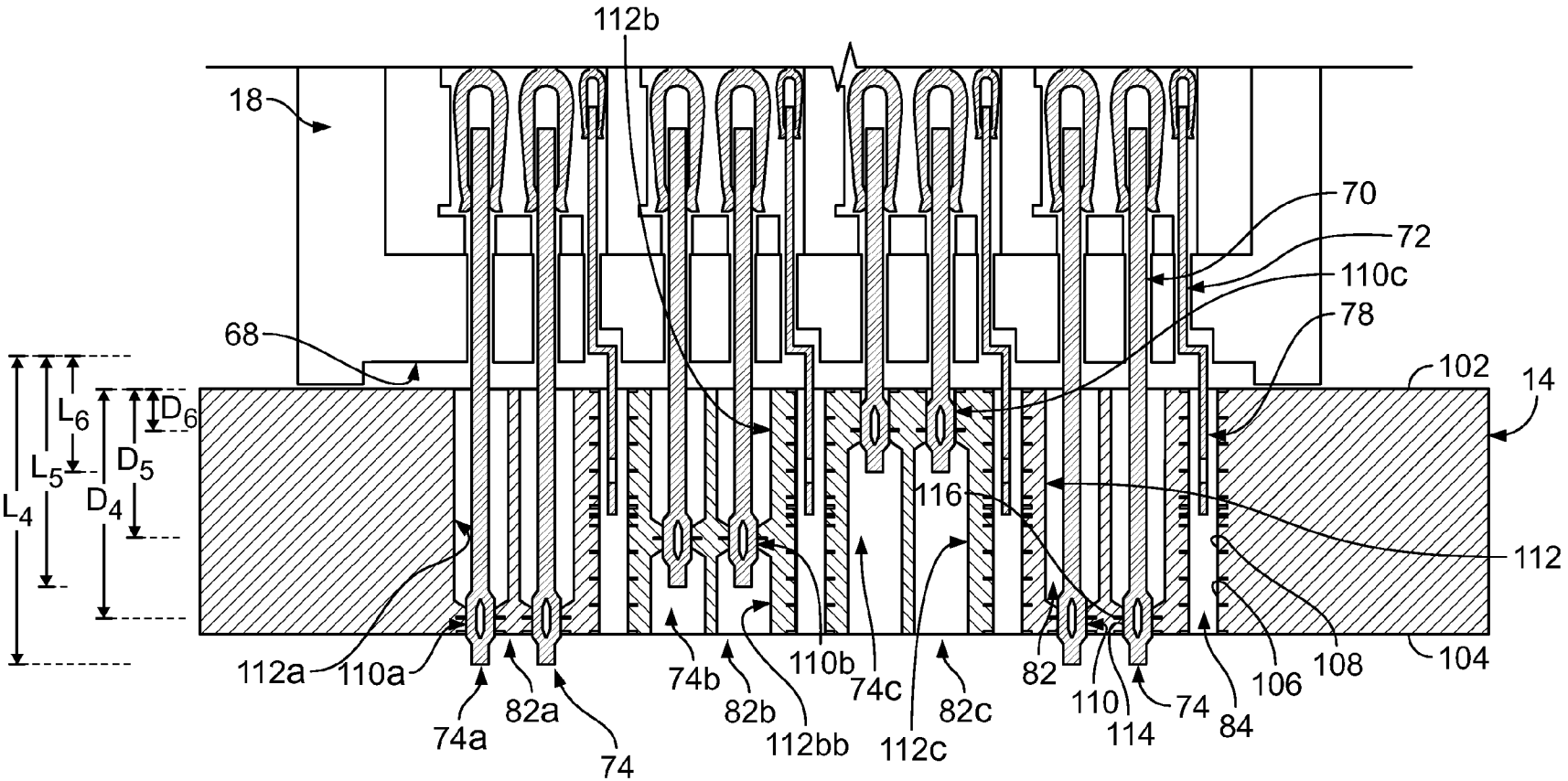
FIG. 6 is a cross-sectional view of a portion of the electrical connector assembly shown in FIG. 1.

Referring now to FIG. 6, some of the mounting contacts 74 of the signal terminals 70 extend different lengths from the mounting face 68 of the header connector 18 than others of the mounting contacts 74. For example, a differential pair 74*a* of the mounting contacts 74 extends a length $L_4$ from the mounting face 68, a differential pair 74*b* of the mounting contacts 74 extends a length $L_5$ from the mounting face 68, and a differential pair 74*c* of the mounting contacts 74 extend a length $L_6$ from the mounting face 68. The lengths $L_4$-$L_6$ are each different. Any of the mounting contacts 74 of the header connector 18 may have a different length from the mounting face 68 than any other mounting contact 74 of the header connector 18. The pattern of the lengths of the mounting contacts 74 shown herein is meant as exemplary only. Although the mounting contacts 74 of each differential pair are shown herein as having approximately the same length from the mounting face 68, alternatively one or more differential pairs includes mounting contacts 74 that have different lengths.

Referring again to FIG. 4, the circuit board 12 includes a pair of opposite surfaces 86 and 88. The mounting face 46 of each of the contact modules 22 is configured to be mounted along the surface 86 such that the receptacle connector 16 is mounted on the surface 86 of the circuit board 12. The circuit board 12 includes the plurality of vias 54 and 56 that receive the mounting contacts 30 and 34, respectively, of the respective signal and ground terminals 26 and 28. The vias 56 include an electrical conductor 90 on a surface 92 defining the via 56. Each electrical conductor 90 defines an electrical contact portion for electrical connection with a corresponding one of the mounting contacts 34 of the ground terminals 28. Each electrical conductor 90 may be formed by any suitable method, process, means, and/or the like, such as, but not limited to, plating and/or the like. The electrical conductor 90 of each via 56 is electrically connected to a ground (not shown) of the circuit board 12. Each of the grounds may be formed on the surface 86, the surface 88, or an internal layer (not shown) of the circuit board 12 that extends between the surfaces 86 and 88.

The vias 54 each include a smaller diameter portion 94 and one or more larger diameter portions 96. For example, a differential pair 54*a* of the vias 54 includes a smaller diameter portion 94*a* that extends adjacent to the circuit board surface 86 and a larger diameter portion 96*a* that extends between the smaller diameter portion 94*a* and the circuit board surface 88. A differential pair 54*b* of the vias 54 includes a smaller diameter portion 94*b* that extends adjacent to the circuit board surface 88 and a larger diameter portion 96*b* that extends between the smaller diameter portion 94*b* and the circuit board surface 86. A differential pair 54*c* of the vias 54 includes a smaller diameter portion 94*c* that extends adjacent an internal layer (not shown) of the circuit board 12, a larger diameter portion 96*c* that extends between the smaller diameter portion 94*c* and the circuit board surface 86, and a larger diameter portion 96*cc* that extends between the smaller diameter portion 94*c* and the circuit board surface 88. The smaller diameter portions 94 each include an electrical conductor 98 on a surface 100 defining the smaller diameter portion 94 of the via 54. Each electrical conductor 98 defines an electrical contact portion for electrical connection with a corresponding one of the mounting contacts 30 of the signal terminals 26. The electrical conductor 98 of each via 56 is electrically connected to a signal trace (not shown) of the circuit board 12. For example, the electrical conductors 98 of the smaller diameter portions 94*a* of the vias 54*a* are each electrically connected to a different signal trace on the circuit board surface 86, the electrical conductors 98 of the smaller diameter portions 94*b* of the vias 54*b* are each electrically connected to a different signal trace on the circuit board surface 88, and the electrical conductors of the smaller diameter portions 94*c* of the vias 54*c* are each electrically connected to a different signal trace on an internal layer (not shown) of the circuit board 12.

As should be apparent from FIG. 4 and the above description of the vias 54, the electrical conductors 98 of some of the vias 54 are located at different depths within the corresponding via 54, and relative to the surface 86 of the circuit board 12, than the electrical conductors 98 of others of the vias 54. For example, in the illustrated embodiment, the electrical conductors 98 of the differential via pair 54*a* are located at a depth $D_1$ relative to the circuit board surface 86, the electrical conductors 98 of the differential via pair 54*b* are located at a depth $D_2$ relative to the circuit board surface 86, and the electrical conductors 98 of the differential via pair 54*c* are located at a depth $D_3$ relative to the circuit board surface 86. The depths $D_1$-$D_3$ (measured from a center of a height of the corresponding electrical conductor 98) are each different. The electrical conductor 98 of any of the vias 54 of the circuit board 12 may have a different depth relative to the circuit board surface 86 than the electrical conductor 98 of any other via 54 of the circuit board 12. Moreover, the electrical conductor 98 of each via may have any suitable depth relative to the circuit board surface 86. The pattern of the depths, as well as the specific depths illustrated, of the electrical conductors 98 of the vias 54 shown herein is meant as exemplary only. Although the electrical conductors 98 of each differential pair of vias 54 are shown herein as having approximately the same depth relative to the circuit board surface 86, alternatively one or more differential pairs of vias 54 include electrical conductors 98 having different depths.

Each electrical conductor 98 may be formed by any suitable method, process, means, and/or the like, such as, but not limited to, plating and/or the like. Each of the vias 54 may be formed using any suitable method, process, means, and/or the like. For example, each of the vias 54 may be formed by forming an opening within the circuit board 12 to define the surface 100 of the smaller diameter portion 94, forming the electrical conductor 98 on the surface 100, and thereafter boring through the circuit board 12 to define the larger diameter portion(s) 96. The boring operation will remove the surface 100 and the electrical conductor 98 from the entirety of the via 54 except for the smaller diameter portion 94.

Although the vias 54 and 56 are each shown extending completely through the circuit board 12, alternatively one or more of the vias 54 and/or 56 may extend only partially through the circuit board 12.

Referring again to FIG. 6, the circuit board 14 includes a pair of opposite surfaces 102 and 104. The mounting face 68 of the header connector 18 is configured to be mounted along the surface 102 such that the header connector 18 is mounted on the surface 102 of the circuit board 14. The circuit board 14 includes the plurality of vias 82 and 84 that receive the mounting contacts 74 and 78, respectively, of the respective signal and ground terminals 70 and 72. The vias 84 include an electrical conductor 106 on a surface 108 defining the via 84. Each electrical conductor 106 defines an electrical contact portion for electrical connection with a corresponding one of the mounting contacts 78 of the ground terminals 72. Each electrical conductor 106 may be formed by any suitable method, process, means, and/or the like, such as, but not limited to, plating and/or the like. The electrical conductor 106 of each via 84 is electrically connected to a ground (not shown) of the circuit board 14. Each of the grounds may be formed on the surface 102, the surface 104, or an internal layer (not shown) of the circuit board 14 that extends between the surfaces 102 and 104.

The vias 82 each include a smaller diameter portion 110 and one or more larger diameter portions 112. For example, a differential pair 82*a* of the vias 82 includes a smaller diameter portion 110*a* that extends adjacent to the circuit board surface 102 and a larger diameter portion 112*a* that extends between the smaller diameter portion 110*a* and the circuit board surface 104. A differential pair 82*b* of the vias 82 includes a smaller diameter portion 110*b* that extends adjacent an internal layer (not shown) of the circuit board 14, a larger diameter portion 112*b* that extends between the smaller diameter portion 110*b* and the circuit board surface 102, and a larger diameter portion 112*bb* that extends between the smaller diameter portion 110*b* and the circuit board surface 104. A differential pair 82*c* of the vias 82 includes a smaller diameter portion 110*c* that extends adjacent to the circuit board surface 104 and a larger diameter portion 112*c* that extends between the smaller diameter portion 110*c* and the circuit board surface 102. The smaller diameter portions 110 each include an electrical conductor 114 on a surface 116 defining the smaller diameter portion 110 of the via 82. Each electrical conductor 114 defines an electrical contact portion for electrical connection with a corresponding one of the mounting contacts 74 of the signal terminals 70. The electrical conductor 114 of each via 82 is electrically connected to a signal trace (not shown) of the circuit board 14. For example, the electrical conductors 114 of the smaller diameter portions 110*a* of the vias 82*a* are each electrically connected to a different signal trace on the circuit board surface 102, the electrical conductors 114 of the smaller diameter portions 110*b* of the vias 82*b* are each electrically connected to a different signal trace on the circuit board surface 102, and the electrical conductors of the smaller diameter portions 110*c* of the vias 82*c* are each electrically connected to a different signal trace on an internal layer (not shown) of the circuit board 14.

As should be apparent from FIG. 6 and the above description of the vias 82, the electrical conductors 114 of some of vias 82 are located at different depths within the corresponding via 82, and relative to the surface 102 of the circuit board 14, than the electrical conductors 114 of others of the vias 82. For example, in the illustrated embodiment, the electrical conductors 114 of the differential via pair 82*a* are located at a depth $D_4$ relative to the circuit board surface 102, the electrical conductors 114 of the differential via pair 82*b* are located at a depth $D_5$ relative to the circuit board surface 102, and the electrical conductors 114 of the differential via pair 82*c* are located at a depth $D_6$ relative to the circuit board surface 102. The depths $D_4$-$D_6$ (measured from a center of a height of the corresponding electrical conductor 114) are each different. The electrical conductor 114 of any of the vias 82 of the circuit board 14 may have a different depth relative to the circuit board surface 102 than the electrical conductor 114 of any other via 82 of the circuit board 14. Moreover, the electrical conductor 114 of each via may have any suitable depth relative to the circuit board surface 102. The pattern of the depths, as well as the specific depths illustrated, of the electrical conductors 114 of the vias 82 shown herein is meant as exemplary only. Although the electrical conductors 114 of each differential pair of vias 82 are shown herein as having approximately the same depth relative to the circuit board surface 102, alternatively one or more differential pairs of vias 82 include electrical conductors 114 having different depths.

Each electrical conductor 114 may be formed by any suitable method, process, means, and/or the like, such as, but not limited to, plating and/or the like. Each of the vias 82 may be formed using any suitable method, process, means, and/or the like. For example, each of the vias 82 may be formed by forming an opening within the circuit board 14 to define the surface 116 of the smaller diameter portion 110, forming the electrical conductor 114 on the surface 116, and thereafter boring through the circuit board 14 to define the larger diameter portion(s) 112. The boring operation will remove the surface 116 and the electrical conductor 114 from the entirety of the via 82 except for the smaller diameter portion 110.

Although the vias 82 and 84 are each shown extending completely through the circuit board 14, alternatively one or more of the vias 82 and/or 84 may extend only partially through the circuit board 14.

Referring again to FIG. 1, when the receptacle connector 16 is mounted on the circuit board 12, the mounting contacts 30 and 34 are each received within the corresponding via 54 and 56, respectively, such that the mounting contacts 30 and 34 are electrically connected to the respective electrical conductor 98 and 90. Some of the mounting contacts 30 of the signal terminals 26 extend different depths, relative to the circuit board surface 86, into the corresponding via 54 than others of the mounting contacts 30 (whether the others are on the same contact module 22 or a different contact module 22). For example, the mounting contacts 30*a* extend the depth $D_1$ into the corresponding vias 54*a*, the mounting contacts 30*b* extend the depth $D_2$ into the corresponding vias 54*b*, and the mounting contacts 30*c* extend the depth $D_3$ into the corresponding vias 54*c*. Any of the mounting contacts 30 of the receptacle connector 16 may extend a different depth into the corresponding via 54 than any other mounting contact 30 of the receptacle connector 16. The pattern of the depths that the mounting contacts 30 extend into the vias 54 shown herein is meant as exemplary only. Although the mounting contacts 30 of each differential pair are shown herein as extending approximately the same depth into the corresponding via 54, alternatively one or more differential pairs includes mounting contacts 30 that extend different depths into the corresponding via 54.

When the header connector 18 is mounted on the circuit board 14 as shown in FIG. 1, the mounting contacts 74 and 78 are each received within the corresponding via 82 and 84, respectively, such that the mounting contacts 74 and 78 are electrically connected to the respective electrical conductor 114 and 106. Some of the mounting contacts 74 of the signal terminals 70 extend different depths, relative to the circuit board surface 102, into the corresponding via 82 than others of the mounting contacts 74. For example, the mounting contacts 74*a* extend the depth $D_4$ into the corresponding vias 82*a*, the mounting contacts 74*b* extend the depth $D_5$ into the corresponding vias 82*b*, and the mounting contacts 74*c* extend the depth $D_6$ into the corresponding vias 82*c*. Any of the mounting contacts 74 of the header connector 18 may extend a different depth into the corresponding via 82 than any other mounting contact 74 of the header connector 18. The pattern of the depths that the mounting contacts 74 extend into the vias 82 shown herein is meant as exemplary only. Although the mounting contacts 74 of each differential pair are shown herein as extending approximately the same depth into the corresponding via 82, alternatively one or more differential pairs includes mounting contacts 74 that extend different depths into the corresponding via 82.

Although the mounting contacts 30 and 74 are shown herein as press-fit contacts the mounting contacts 30 and 74 may each be any suitable type of electrical contact that enables the mounting contacts 30 and 74 to function as described herein, such as, but not limited to, the press-fit type shown herein, a surface mount type, and/or a solder tail type. The mating contacts 32 and 76 may each be any suitable type of electrical contact that enables the mating contacts 32 and 76 to function as described herein, such as, but not limited to, a press-fit type, a surface mount type, and/or a solder tail type.

In the exemplary embodiment, the circuit boards 12 and 14 are interconnected using both the receptacle connector 16 and the header connector 18. Alternatively, the receptacle connector 16 directly interconnects the circuit boards 12 and 14 without the header connector 18 intervening between the circuit board 14 and the receptacle connector 16. Similarly, the header connector 18 may directly interconnect the circuit boards 12 and 14 without the receptacle connector 16 intervening between the circuit board 12 and the header connector 18.

The embodiments described and/or illustrated herein provide an electrical connector that may enable improvement of the density and/or electrical performance of circuit board footprints to achieve higher system densities and/or higher system speeds. For example, the embodiments described and/or illustrated herein, when left at the same density as at least some known systems, may decrease via to via coupling and may increase circuit board footprint impedance. Alternatively, the embodiments described and/or illustrated herein may be able to achieve higher footprint densities than at least some known systems while maintaining the same via to via coupling and impedance levels of such known systems.

It is to be understood that the above description is intended to be illustrative, and not restrictive. For example, the above-described embodiments (and/or components, steps, and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." When introducing elements/components/etc. described and/or illustrated herein, the articles "a", "an", "the", "said", and "at least one" are intended to mean that there are one or more of the element(s)/component(s)/etc. Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described and/or illustrated in terms of various specific embodiments, those skilled in the art will recognize that the subject matter described and/or illustrated herein can be practiced with modification within the spirit and scope of the claims.

What is claimed is:

1. An electrical connector for mounting on a circuit board having first and second vias, the electrical connector comprising:

a housing having a mounting face for mounting along the circuit board, the housing comprising a plurality of individual contact modules; and first and second terminals held by at least one of the contact modules of the housing, the first and second terminals comprising respective first and second mounting contacts extending outward from the mounting face of the housing, the first and second mounting contacts being configured to be received within the first and second vias, respectively, of the circuit board, wherein the first and second mounting contacts extend different first and second lengths, respectively, from the mounting face of the housing, the housing holding a third terminal that comprises a third mounting contact extending outward from the mounting face of the housing, the third mounting contact extending a third length from the mounting face of the housing, the third length being different than the first and second lengths.

2. The electrical connector according to claim 1, wherein the housing holds fourth and fifth terminals, the first and fourth terminals being arranged as a first differential pair and the second and fifth terminals being arranged as a second differential pair.

3. The electrical connector according to claim 1, wherein the housing holds fourth and fifth terminals, the first and fourth terminals being arranged as a first differential pair and the second and fifth terminals being arranged as a second differential pair, the fourth terminal comprising a fourth mounting contact that extends approximately the first length from the mounting face of the housing, the fifth terminal comprising a fifth mounting contact that extends approximately the second length from the mounting face of the housing.

4. The electrical connector according to claim 1, wherein the housing comprises a mating face for mating with another electrical connector, the first and second terminals comprising respective first and second mating contacts extending along the mating face of the housing, the first and second mating contacts being configured to engage electrical contacts of the other electrical connector.

5. The electrical connector according to claim 1, wherein the housing comprises a mating face for mating with another electrical connector, the first and second terminals comprising respective first and second mating contacts extending along the mating face of the housing, the first and second mating contacts being configured to engage electrical contacts of the other electrical connector, wherein the mating face is oriented approximately perpendicular or approximately parallel to the mounting face.

6. The electrical connector according to claim 1, wherein the mounting contacts comprise press-fit contacts.

7. A contact module for an electrical connector, said contact module comprising:

a housing having a mounting face for mounting along a circuit board; and a lead frame held by the housing, the lead frame comprising first and second signal terminals comprising respective first and second mounting contacts extending outward from the mounting face of the housing, the first and second mounting contacts being configured to be electrically connected to the circuit board, wherein the first mounting contact extends a different length from the mounting face of the housing than the second mounting contact, wherein the different lengths of the first and second mounting contacts are first and second lengths, respectively, the housing holding a third signal terminal that comprises a third mounting contact extending outward from the mounting face of the housing, the third mounting contact extending a third length from the mounting face of the housing, the third length being different than the first and second lengths.

8. The contact module according to claim 7, wherein the lead frame further comprises fourth and fifth signal terminals, the first and fourth signal terminals being arranged as a first differential pair and the second and fifth signal terminals being arranged as a second differential pair.

9. The contact module according to claim 7, wherein the lead frame further comprises fourth and fifth signal terminals, the first and fourth signal terminals being arranged as a first differential pair and the second and fifth signal terminals being arranged as a second differential pair, the fourth signal terminal comprising a fourth mounting contact that extends approximately the first length from the mounting face of the housing, the fifth signal terminal comprising a fifth mounting contact that extends approximately the second length from the mounting face of the housing.

10. The contact module according to claim 7, wherein the housing comprises a mating face for mating with another electrical connector, the first and second signal terminals comprising respective first and second mating contacts extending along the mating face of the housing, the first and second mating contacts being configured to engage electrical contacts of the other electrical connector.

11. The contact module according to claim 7, further comprising the circuit board, wherein the circuit board comprises first, second, and third vias each extending at least partially through the circuit board, at least one of the first, second and third vias comprising a smaller diameter portion and a larger diameter portion, the smaller diameter portion comprising an electrical conductor.

12. An electrical connector assembly comprising:

a circuit board comprising first and second vias each extending at least partially through the circuit board, wherein at least one of the first via and the second via comprises a smaller diameter portion and a larger diameter portion; and an electrical connector configured to be mounted on the circuit board, the electrical connector comprising:

a housing having a mounting face configured to be mounted along the circuit board; and first and second signal terminals held by the housing, the first and second signal terminals comprising respective first and second mounting contacts extending outward from the mounting face of the housing, the first and second mounting contacts being configured to be received within the first and second vias, respectively, of the circuit board, wherein the first and second mounting contacts are configured to extend different depths into the respective first and second vias of the circuit board.

13. The electrical connector assembly according to claim 12, wherein electrical connector is mounted on the circuit board, the circuit board comprising a surface, the first mounting contact extending into the first via a first depth relative to the surface of the circuit board, the second mounting contact extending into the second via a second depth relative to the surface of the circuit board, the first depth being different than the second depth.

14. The electrical connector assembly according to claim 12, wherein the circuit board comprises a surface, the first and second vias comprising respective first and second electrical conductors having respective first and second electrical contact portions, the first and second mounting contacts being configured to engage and electrically connect to the respective first and second electrical contact portions, wherein the first and second electrical contact portions are located within the respective first and second vias at different depths relative to the surface of the circuit board.

15. The electrical connector assembly according to claim 12, wherein the circuit board comprises a surface, the first and second vias comprising respective first and second smaller diameter portions and respective first and second larger diameter portions, the first and second smaller diameter portions each comprising an electrical conductor, wherein the first and second smaller diameter portions are located within the respective first and second vias at different depths relative to the surface of the circuit board.

16. The electrical connector assembly according to claim 12, wherein the circuit board comprises opposite first and second surfaces, the electrical connector being configured to be mounted on the first surface, the first via comprising a smaller diameter portion comprising an electrical conductor and a larger diameter portion extending between the smaller diameter portion and the first surface.

17. The electrical connector assembly according to claim 12, wherein the circuit board comprises opposite first and second surfaces, the electrical connector being configured to be mounted on the first surface, the first via comprising a smaller diameter portion comprising an electrical conductor, the first via comprising a first larger diameter portion extending between the smaller diameter portion and the first surface and a second larger diameter portion extending between the smaller diameter portion and the second surface.

18. The electrical connector assembly according to claim 12, wherein the housing comprises a mating face for mating with another electrical connector, the first and second signal terminals comprising respective first and second mating contacts extending along the mating face of the housing, the first and second mating contacts being configured to engage electrical contacts of the other electrical connector.

* * * * *